US005551173A

United States Patent [19]

Chambers

[11] Patent Number: 5,551,173

[45] Date of Patent: Sep. 3, 1996

[54] COMFORT INSOLE

[76] Inventor: Mark D. Chambers, 3210 E. Vermont Ave., Phoenix, Ariz. 85018

[21] Appl. No.: 405,147

[22] Filed: Mar. 16, 1995

[51] Int. Cl.[6] ..... A43B 13/38; A43B 7/06

[52] U.S. Cl. ..... 36/44; 36/141; 36/3 B

[58] Field of Search ..... 36/43, 44, 88, 36/91, 3 R, 3 B, 140, 141, 145, 166, 176, 173, 174, 180

[56] References Cited

U.S. PATENT DOCUMENTS

| | | | |
|---|---|---|---|
| 4,020,570 | 5/1977 | Shames | 36/28 |
| 4,043,058 | 8/1977 | Hollister et al. | 36/102 |
| 4,185,402 | 1/1980 | Digate | 36/3 B |
| 4,481,725 | 11/1984 | Bergmans | 36/11 |
| 4,590,689 | 5/1986 | Rosenberg | 36/44 |
| 4,841,647 | 6/1989 | Turucz | 36/44 |

FOREIGN PATENT DOCUMENTS

| | | | |
|---|---|---|---|
| 2048240 | 2/1993 | Canada | 36/141 |

*Primary Examiner*—Ted Kavanaugh
*Attorney, Agent, or Firm*—Gregory J. Nelson

[57] ABSTRACT

A reversible insole having a composite structure in which a base insole layer of resilient cushioning material has fabric bonded to its opposite surfaces. Protuberances extend from one surface so the insole may be worn as either a massaging insole or a comfort insole. The insole may be printed with a representation of a reflexology chart and protuberances located to massage selected areas of the foot. Apertures are provided for air circulation. In an alternate embodiment the protuberances are selectively attachable to the base insole.

8 Claims, 3 Drawing Sheets

COMFORT INSOLE

FIELD OF THE INVENTION

The present invention relates to orthotic devices and more particularly relates to insoles for shoes. Insoles according to the invention are of the type having foot massaging protuberances extending from one surface and when worn in a first position will massage the user's feet when walking or running and which insoles may be worn in a second, reverse position to support the insole above the shoe surface to provide air circulation.

Orthotic devices of the insole type are well known. Early insole designs generally consisted of a pad of cushioning material such as sponge rubber that had a general shape conforming to the interior shape of a shoe. Wearers suffering from foot trouble would insert the cushion into the shoe to provide added cushioning and support. Later enhancements to insoles were developed which provided some type of massage.

BACKGROUND OF THE INVENTION

Prior Art

The following patents are representative and illustrate the development of the prior art in the field of insoles.

U.S. Pat. No. 2,139,971 to Pava shows an arch support of sponge rubber which is curved to the shape of the foot and has radially spaced ridges under its central region.

U.S. Pat. No. 3,757,774 discloses a novel sandal which is claimed to improve the health of the body and feet having projections provided on the upper and lower surface to stimulate the sole of the foot to facilitate circulation during walking.

Other later patents show massaging insoles. For example, U.S. Pat. No. 4,047,310 shows a podiatric device molded to the contour of the planar surface of the foot having a plurality of uniformly distributed rigid studs extending upwardly.

U.S. Pat. No. 4,033,054 shows footwear having pressure projections which are positioned to pressure or stimulate effective spots of the foot. The pressure projections each have a magnet for applying a magnetic field to the areas.

A number of patents relating to footwear and specifically massaging type insoles, position massaging cushions or protuberances in areas corresponding to the reflex zones of the foot. U.S. Pat. No. 4,694,831 discloses footwear with an inner sole having upwardly projecting support platforms with foot stimulating dome-shaped bumps on areas not occupied by the platforms. The patentee claims an accupressure application occurs when walking that is capable of effectively massaging the soles of the feet to stimulate appropriate meridians to enhance and normalize circulation.

U.S. Pat. No. 4,760,655 shows an insole having on its upper surface in the region of the foot's reflex zones, flat and somewhat lenticular resilient massaging cushions made of latex rubber which correspond in contour and extent to the respective reflex zone to be stimulated.

U.S. Pat. No. 4,841,647 issued to Sandor Turucz shows shoe insoles having convex protuberances extending from the base of the insoles for providing a rhythmic pressure and massaging action on the soles of the feet during walking. The base is a resilient or spongy material and the protuberances are somewhat more firm so that during walking the protuberances will sink into the base and extend from the base on the lifting portion of the walking gait. The protuberances have geometric forms and are disposed on the base so as to massage certain zones of the soles of the wearer's feet to simulate an accupressure massage. The present invention particularly represents an improvement to the Turucz-type insole.

Thus, while insoles designed to apply massaging in accordance with the ancient technique of reflexology are well known, there nevertheless exists a need for an improved insole of the type which will provide the massage in accordance with reflexology or accupressure techniques if desired by the user and may also be used as a conventional cushioning insole providing good air circulation.

Reflexology or accupressure is an ancient technique involving massaging of strategic points on the soles of the feet. An essential or underlying principle of reflexology is that various organs or muscles of the body are connected by a network of nerves to certain spots or zones on the sole of the feet. Massage applied to these spots or areas promotes circulation of blood flow to the target organ. Additionally, it is theorized that there are channels of energy flowing through the body and that this energy terminates at these strategic spots in the feet.

Accordingly, it is believed that massaging these various strategic zones of the foot results in a revitalization of energy of the person and reflex theory suggests that massaging action unobstructs the flow of energy through these energy channels or passageways. Whether or not one accepts reflexology theory, it is known that massage applied to specific locations of the feet does result in relaxation of the body and that cushioning insoles placed in footwear will reduce fatigue, increase comfort and give the wearer greater endurance.

SUMMARY OF THE INVENTION

Briefly, in accordance with the present invention, insoles are provided having protuberances or projections disposed on one insole surface which are relatively firm but also have some resiliency. The protuberances extend from a resilient insole base having moisture-absorbing fabric on both sides. The base has the peripheral shape of the foot. The insoles may be worn in one of two positions: (1) the comfort position; and (2) the massaging position. In the massaging position, with the protuberances oriented upwardly, the insole functions to provide the healthful massage described above. With the protuberances oriented downwardly in the comfort position, the protuberances function as shock absorbers for the insole which with the insole and protuberances working together, provide a comfortable cushion for the wearer. Also, in the comfort position the protuberances and insole base serve to establish a beneficial air flow through apertures in the insole and around its periphery.

The protuberances are located to correspond to areas or zones which are associated with the various organs of the body according to reflexology theory so that healthful accupressure and massaging occurs. The relative firmness of the protuberances in relation to the resiliency of the cushioning effect of the insole base are selected so that the protuberances will depress into the insole as walking occurs. This promotes massage and avoids any uncomfortable sensation being transmitted to the wearer.

In a preferred embodiment, the insole cushioning material and protuberances are formed from resilient material such as rubber, expanded foam or cellular molded rubber (CMR). The opposite surfaces of the insole base are covered by a moisture-absorbing fabric material which is laminated to the cushioning material. A representation of a reflexology chart may be graphically provided on one surface of the insole.

In other embodiments, the insole may be provided with notches around the periphery and apertures extending through the insole to further provide circulating air flow. A gel-like fluid may be contained within the protuberances to enhance the massaging and cushioning effect.

In still another embodiment, the insole is provided in a kit form with detachable and attachable protuberances of various shapes which may be selectively secured at desired locations by the user. The method of attachment may be in the form of adhesives or frictional engagement.

In still another embodiment, a plurality of protuberances may be provided on the substrate conforming to a section of the insole such as the toe portion, the heel portion or the metatarsal portion which section may then be selectively attached to the insole surface as desired by the user.

The insoles may also be formed as part of the footwear surface but preferably are insertable insoles which can be used with more than one pair of shoes and which facilitate reversible positioning as described above.

The location and arrangement of the protuberances although corresponding to the reflex zone, may be varied in accordance with the requirements of the user.

The above and other objects and advantages will be apparent from the following description taken in conjunction with the accompanying drawings in which:

DESCRIPTION OF THE PREFERRED EMBODIMENTS

Figure 5:
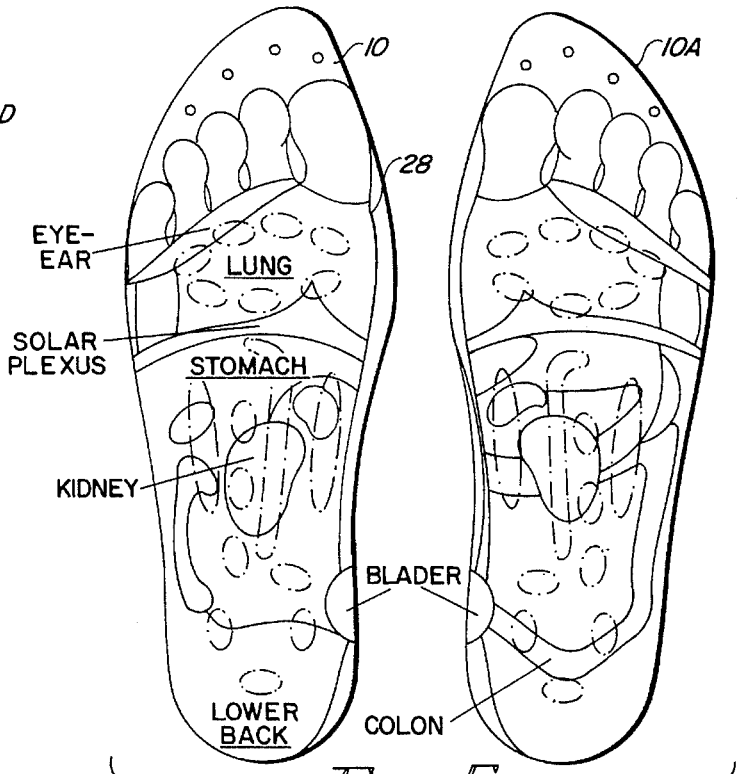
FIG. 5 is a planar view of a pair of insoles as viewed from the side bearing the protuberances and further carrying a graphic representation of the wearer's feet and illustrating the representative massage therapy zones.
Figure 15:
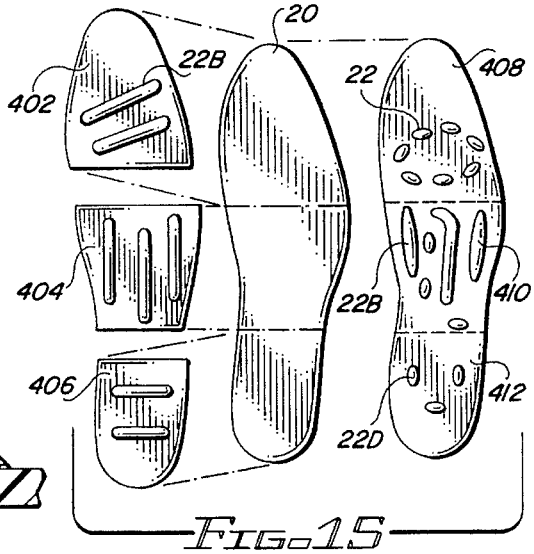
FIG. 15 is a plan view illustrating the protuberance carrying sections which may be selectively attached to an insole.

Turning now to the drawings, the insole of the present invention as seen in FIGS. 1, 2 and 5 to 7 is generally represented by the numeral 10 and has a curved toe portion 12, heel portion 14, medial arch portion 16 and lateral edge portion 18. As viewed in plan view, the insole has the shape of a human foot and the insoles would normally be sold in pairs having a companion 10A as seen in FIG. 5. Typically, the insoles would be sized corresponding to shoe sizes and provided in sized pairs, although a later embodiment of the present invention as seen in FIG. 15 relates to a universal insole which may be trimmed to the requirements of the user.

Figure 2:
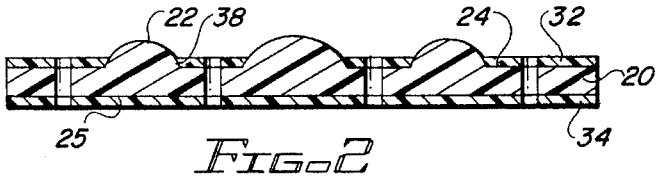
FIG. 2 is a cross sectional view taken along line 2—2 of FIG. 1.

The insole, as seen in cross section in FIG. 2, has a laminate construction with an intermediate base insole 20 of a resilient elastomeric material. Examples of such elastomeric materials include polyethylene, polyurethane, latex or rubber. One particularly suitable rubber material is known as CMR which is an abbreviation for cellular molded foam rubber.

A plurality of spaced projections or protuberances 22, 22A, 22B, 22C and 22D project from one surface 24 of the base. The opposite surface 25 of the base 20 is essentially planar.

The protuberances 22, 22A, 22B, 22C, 22D have different shapes and may be variously arranged on the surface 74 of the base so as to correspond to selected areas corresponding to the desired reflex area or zone of the foot. For example, in FIG. 5 the surfaces of insoles 10 and 10A are shown with the map or outline of a foot 28 superimposed on the insole and with various selected reflex areas indicated. According to the reflex theory, massage of selected areas of the foot will relax the body and will have a beneficial effect and the well-being of certain organs. As seen in FIG. 5, the various foot areas according to reflex theory have been selectively labeled indicating their connection by nerves or energy channels to the indicated organs.

Protuberances 22 are shown as being generally elliptical and are positioned beneath the ball of the foot on an area of the insole corresponding to the zone marked "lungs". Additional elongate protuberances 22A, 22B and 22C are located in the intermediate insole area corresponding to zones indicated by such organs as the stomach, liver and the like. On the heel section of the insole, additional elliptical protuberances 22D are located in zones which correspond to lower back and small intestine zones.

The particular configuration of the protuberances may vary and they may be symmetrical such as elliptical or circular when viewed in plan view or may be elongate such as those indicated by the numerals 22B, 22C. The cross sectional configuration of the protuberances, as seen in FIG. 2, is generally convex or lenticular. The specific location of the protuberances, the geometrical array and the disposition as to length and width may vary and is selected to conform to zones of the sole map to provide the desired massaging actions to the particular zones.

Preferably the protuberances 22, 22A, etc. have a density greater than the density of the layer 20. In this way, when a pressure is applied to the insole, the protuberances will tend to be depressed into the intermediate base laminate. When the weight or force is removed, the protuberances being resilient and having memory will return to their original shape and position. For example, a preferred range of density for the base 25 is 45 to 85 Shore Hardness and a preferred range for the protuberances is 60 to 90 Shore Hardness.

Surface 24 of the cushioning laminate 20 is covered with a fabric layer material 32 having die cut apertures or openings 38 at predetermined locations to accommodate the protuberances 22 to 22D. The openings are pre-cut conforming to the size and location of the protuberances. The layer of fabric material 32 is for the comfort of the user providing a soft, dry and cool surface against the foot. Various natural and synthetic fabric materials may be used. One particularly suitable material is a laminate structure of polyester and hydrofilled nylon which absorbs foot perforation. A material of this type is sold under the trademark "Drilex" and is manufactured by Faytex of Weymouth, Mass. Another suitable material is Neoprene. A fabric layer 34 having characteristics the same or similar to that of fabric layer 32 is applied and bonded to the planar surface of the resilient laminate.

Figure 3:
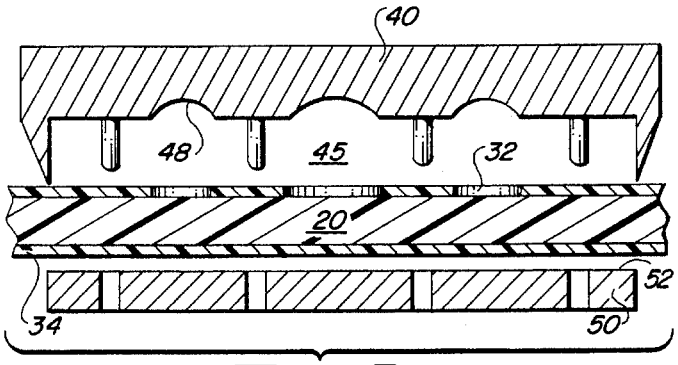
FIGS. 3 and 4 are pictorial views representing the method of making the insole.
Figure 4:
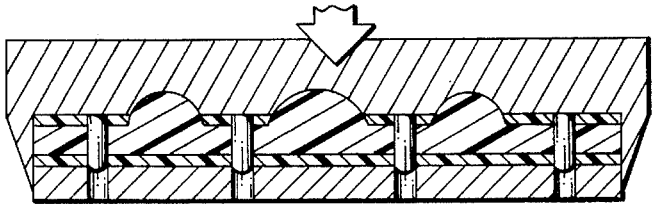

FIGS. 2 through 4 illustrate the method of making the insole according to the present invention. As seen in FIG. 3, the insole is initially assembled in a composite laminate structure with the exterior fabric layers 32 and 34 positioned on either side of a sheet or blank of the resilient material 20. Molding of an insole or a sheet from which a plurality of insoles may later may be die cut is accomplished by molds having sections 40 and 50. The mold section 40 has a cavity area 45 which defines a plurality of recess areas 48 which conform to the desired shape and location of the protuberances in the finished insole. Lower mold section 50 has a planar surface 52. When in a closed position, the peripheral parting surfaces of the mold are brought into intimate contact so that the material positioned in the mold cavity is compressed. A blank of resilient material such as CMR having an approximate thickness of ¼" is positioned in the mold cavity arranged between opposite layers of fabric material 32 and 34. A bonding material such as a foam adhesive may be applied intermediate the resilient and fabric layers so that the layers may be flame laminated as is known in the molding and adhesive arts. The cut-outs 38 in the fabric layer 32 are aligned or register with the various recesses 48. Upon closing of the mold under application of pressure such as hydraulic pressure, the resilient material is generally compressed causing the fabric layers to bond to the opposite surfaces of the resilient material 20 and the foam dissipates. Further, the intermediate resilient material is compressed causing the material to be forced into the various recesses 48 in the cavity forming the protuberances. The protuberances have a density somewhat greater than the density of the planar section of the resilient material. The closed mold containing the materials of the insole may be heated in any convenient manner such as an air-heated oven.

Typically heating is conducted so the material is elevated to a temperature of about 250° to 500° for about one to twenty minutes. After cooling and release of pressure, the article is removed from the mold and can be finished by trimming to the desired shape by die cutting or other conventional techniques.

Figure 1:
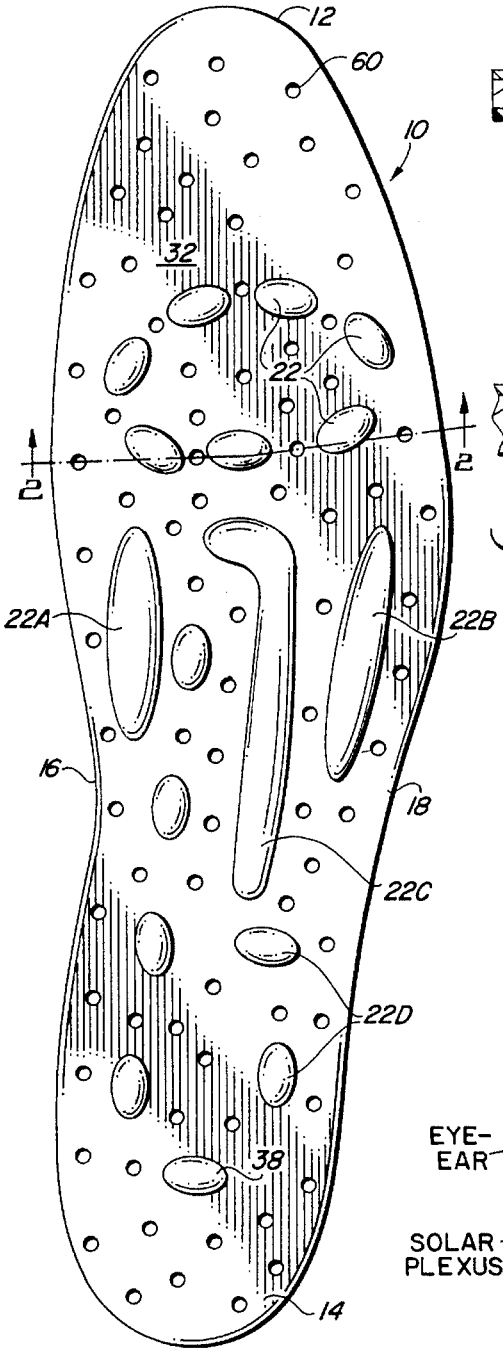
FIG. 1 is a planar view of the insole of the present invention looking at the surface of the insole carrying the massaging protuberances.

Further, as seen in FIG. 1, the insole is preferably provided with a plurality of randomly spaced apertures or holes 60 which extend entirely through the insole. The purpose of these holes is to promote a circulating flow of air when the insole is worn in the shoe. Circulation of air will facilitate drying of the fabric surface layers of the insole and will also maintain the user's foot in a cooler condition. The holes 60 may be punched in the insole after molding.

Figure 6:
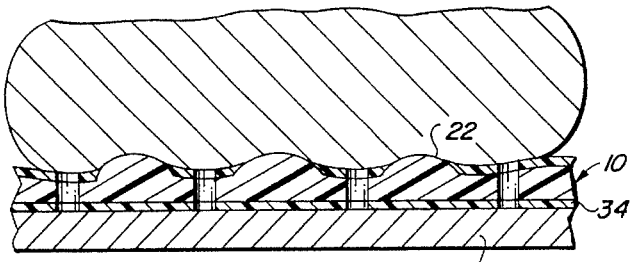
FIG. 6 is a partial cross sectional view showing an insole according to the present invention inserted between a footwear surface and the wearer's foot with the protuberances oriented toward the wearer's foot.

A significant advantage of the insole according to the present invention is that it may be worn in one of two use positions or modes. In one position, termed the massaging mode or position, the protuberances 22 are oriented upwardly as seen in FIG. 6. In the massaging mode the protuberances engage selected areas on the underside of the wearer's foot and the surface 34 contacts the shoe sole 55. The action of walking or running creates a rhythmic, localized pressure on the soles of the feet at zones associated with particular organs.

Figure 7:
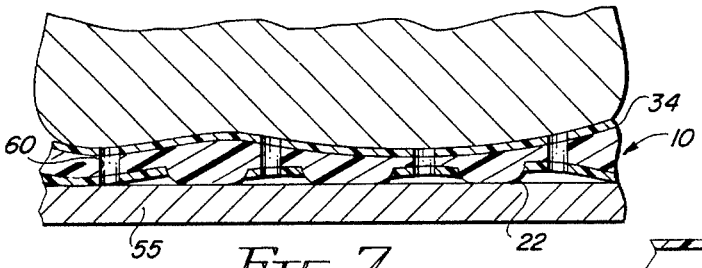
FIG. 7 is a view similar to FIG. 6 but with the insole reversed with the protuberances oriented toward the footwear surface.

As seen in FIG. 7, the insole 10 may be positioned in a shoe in the reverse position with the generally planar surface 25 oriented upwardly and disposed against the planar surface of the foot. As seen in FIG. 7, the protuberances now project downwardly engaging the sole 55 of the shoe elevating the insole above the shoe surface facilitating a flow of cooling and drying air around the protuberances and through the apertures 60. The normal walking or running motion will continually flex the insole creating a pumping action increasing the air flow for the comfort of the wearer.

Figure 8:
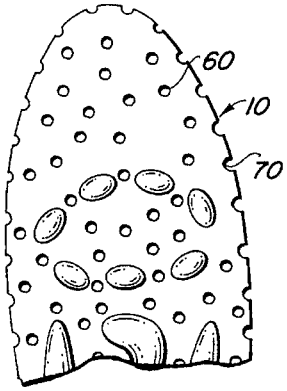
FIG. 8 is a partial plan view of the toe portion of an insole having both apertures and peripheral serrations which facilitate air flow.

In FIG. 8, a modification of the insole is shown in which the peripheral edge of the insole is provided with a plurality of spaced-apart serrations or indentations 70 in addition to apertures 60. In reference to this embodiment and other embodiments, the same or similar reference numerals are used to identify the same or similar elements. The addition of the peripheral serrations 70 will further facilitate a flow of air in the comfort mode as air will more easily circulate from the upper to lower surface at the peripheral edge of the insole which flow of air might otherwise be impeded at the interior shoe surface.

Figure 9:
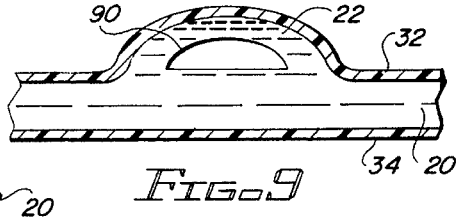
FIG. 9 is a cross sectional view of an alternate form of the protuberances filled with a shock-absorbing gel or fluid.

FIG. 9 is a cross sectional view of another alternate construction in which the insole is again formed having an intermediate resilient layer positioned between oppositely disposed fabric layers 32, 34 which when compressed together form a composite laminate structure. A plurality of protuberances 22 extend from the insole at areas or zones corresponding to selected reflex zones.

The individual protuberances may be of various shapes, size and location as explained above. In FIG. 9, the protuberance 22 is shown as being generally convex having a semi-spherical or semi-elliptical shape. A cavity 90 is defined within at least selected protuberances, the cavity is hollow and is filled with a suitable viscous gel-like fluid such as silicone. The fluid may be injected into the cavity or contained within its own flexible pouch. The resiliency of the insole and the resiliency of the protuberances along with the effect of the viscous fluid all contribute to a comfortable and effective massaging effect. As an alternative, the cavities 90 may be formed as air pockets to provide the desired resiliency.

Figure 10:
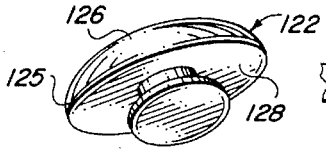
FIG. 10 is a perspective view of a protuberance that is selectively attachable to the insole.
Figure 11:
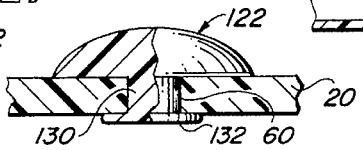
FIG. 11 is a partial cross sectional view of the insole showing the protuberance of FIG. 10 inserted into an aperture in the insole.

In the preceding embodiments, the protuberances 22, 22A, etc. were integrally formed as part of the insole, however, these protuberances may be separately formed and selectively attached to the insole as desired by the user. In FIGS. 10 and 11 a selectively attachable protuberance is shown. In FIG. 10 the protuberance is indicated by the numeral 122 and has a dome-shaped body 125 having a curved upper surface 126 and a generally planar lower surface 128. A short stem 130 projects from the planar surface at a central location having a length generally corresponding to the thickness of the insole component. The insole base component 20 consists of resilient material which may be provided with moisture-absorbing fabric layers bonded to the opposite surfaces. The protuberance 122 may be selectively attached at the desired location on the insole by inserting the protuberance into a selected aperture 60. Since the insole is resilient, it will deflect to accept insertion of the stem and passage of the flange 132. Once inserted, the flange 132 will assume a position engaging the surface of the insole opposite the protuberance so as to retain the protuberance in place. Generally a user would position the protuberances in accordance with the reflex areas or zones as shown in FIG. 5. The selectively positionable protuberances may be variously configured as previously described.

Figure 12:
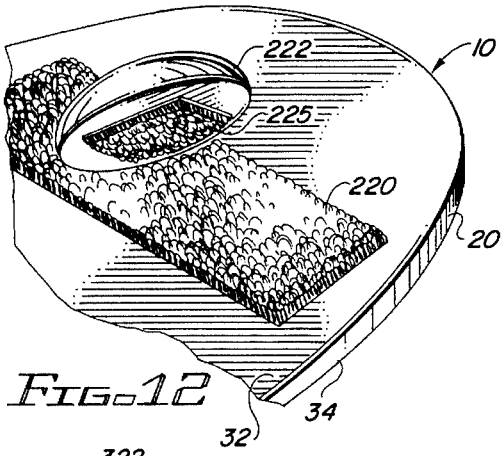
FIG. 12 is a partial perspective view of a portion of an insole showing a protuberance attachable by means of a loop and hook fastener.

In FIG. 12, another embodiment of the present invention is shown again having the insole base substrate 20 of resilient material oppositely covered with moisture-absorbing fabric layers 32 and 34. Selected areas of the surface of fabric covering 32 are provided with sections 220 of a portion of a loop and hook fabric fastener. Alternatively, the fabric covering 32 may be woven and have the characteristics of one portion of a loop and hook fastener. The protuberance 222 which again may be any desired configuration but is shown as being dome shaped having a section of fastener material 225 on its lower surface to facilitate selective positioning on the insole base.

Figure 13:
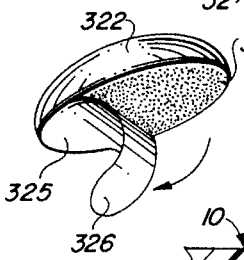
FIG. 13 is a perspective view of a selectively attachable protuberance having an adhesive surface covered by removable, peelable cover.
Figure 14:
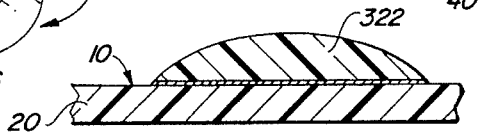
FIG. 14 is a partial sectional view of an insole showing the protuberance of FIG. 13 secured thereto.

Referring to FIGS. 13 and 14, the lower planar surface of the dome-like protuberance 322 is coated with a suitable adhesive 324. The adhesive is covered by a peelable backing 325 having a tab 326. The user then selects the appropriately shaped protuberance 324 and position it on a surface of the base insole 20 by removing the peelable backing and adhering the protuberance to the insole surface. The user can refer to the graphically represented reflex zone imprinted on a surface of the insole to assist in selecting the appropriate and desired location of the protuberance in order to achieve a massaging effect in a desired area.

In FIG. 15 the insole is shown having a pre-cut base 20 of resilient material such as CMR in the desired size and in the general outline shape of the foot. With this embodiment, the user is provided with a plurality of sections 402, 404, 406, 408, 410 and 412 which consists of a base of fabric material such as Drilex fabric having attached or bonded to a surface projections 22, 22A, etc. in various shapes and arrangements. The sections 402 to 412 correspond in shape, for example, to the toe portion, the intermediate arch portion and the heel portion of the insole. Preferably the individual sections are provided with an adhesive backing having a peelable cover similar to that shown in FIG. 13. The user then selects the desired combinations of heel, toe and arch sections and applies them to the insole substrate by removing the peelable backing and pressing the sections to the corresponding portion of the insole.

Figure 16:
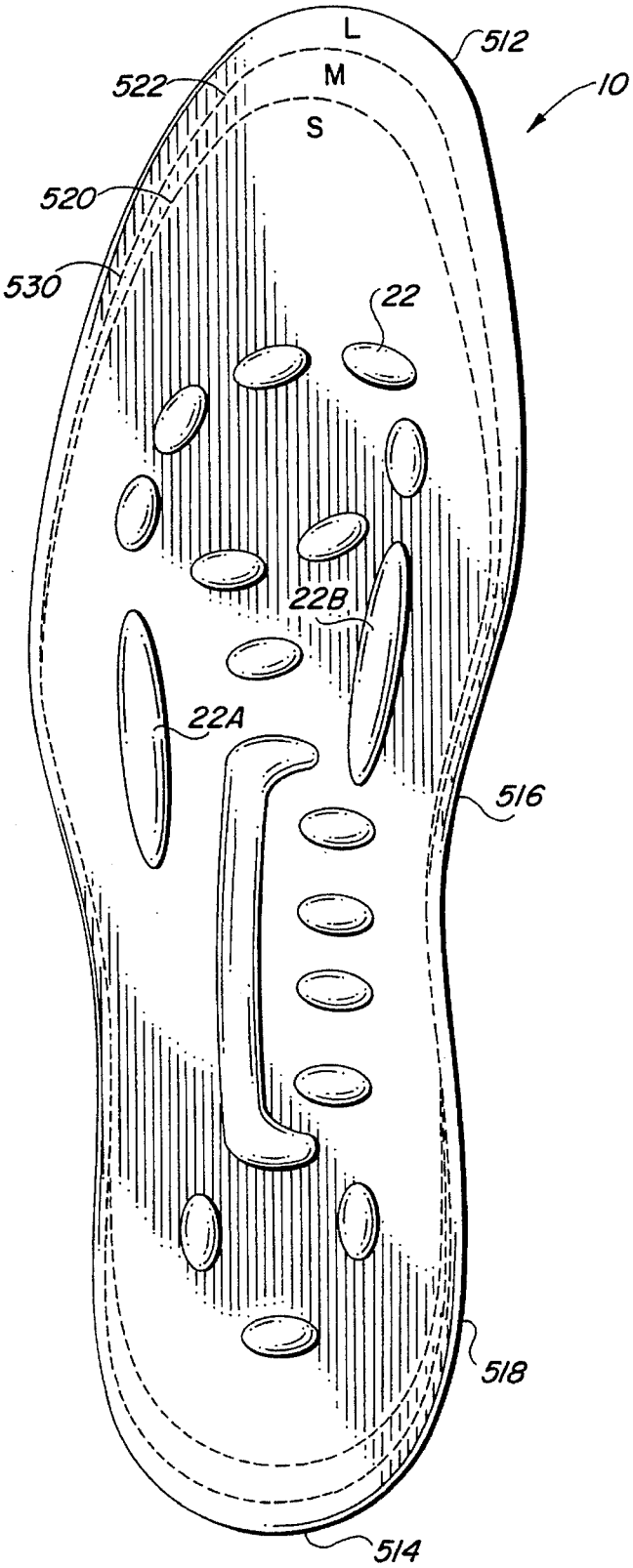
FIG. 16 is a plan view illustrating a universal or one-size-fits-all insole which may be trimmed to the physical requirements of the wearer.

Turning to FIG. 16, a representation of the insole 10 is shown which may be universally sized and trimmed to fit by the user. The insole has a peripheral shape conforming to the shape of the human foot having arcuate toe section 512, heel sections 514 and a convergent medial arch section 516. The insole is constructed as has been described above having a base of suitable resilient material such as latex, CMR, or polymeric foam, preferably provided with a fabric, moisture-absorbing layer on either side. A number of resilient protuberances 22, 22A, etc. are provided at selected locations which preferably correspond to selected reflex zones of the foot. A graphic may be imprinted on a surface of the insole to indicate these various reflex zones.

Patterns 520 and 522 are representative of various sizes of the human foot are also represented on the insole base. For example, the first continuous pattern 520 is representative of a smaller size insole, as for example a man's small. A second continuous pattern line 522 extends around the periphery of the insole indicative of another size of insole, as for example a man's medium. The outer periphery of the insole is sized corresponding, for example, to a man's large insole. If the user requires a size other than the large sizes indicated, the wearer using the printed pattern lines on the insole trims the insole with a scissors or cutting instrument to the proper size. The trim lines may be imprinted by conventional printing techniques, silkscreening and the like. As an alternative, the print lines may also be perforated at 530 having 1/16" perforations so that the smaller size insole may be separated by tearing along the appropriate trim lines which tearing operation is facilitated by the inclusion of perforations.

As discussed at length above, the protuberances provide the various embodiments of the insole of the present invention and preferably are located in areas corresponding to the reflex zones. The protuberances massage the wearer's feet while walking or running to stimulate the tissues of the sole of the foot and increase the blood supply to the tissues. A significant advantage of the present invention is that the insole may be worn in the massaging mode with the protuberances engaging the planar surface of the wearer's foot or may be reversed and in which case would be worn as a more conventional comfort cushioning insole. In the comfort mode, air circulation is promoted by the elevating of the insole above the shoe surface by reason of the protuberances. Thus, the protuberances serve two important functions depending on the mode in which insole is worn. The present invention also facilitates customizing the insole to the size and massage requirements of the particular wearer.

While the principles of the invention have been made clear in the illustrative embodiments set forth above, it will be obvious to those skilled in the art to make various modifications to the structure, arrangement, proportion, elements, materials and components used in the unique insole described herein. To the extent that these various modifications do not depart from the spirit and scope of the appended claims, they are intended to be encompassed therein.

I claim:

1. An insole for insertion into footwear between the planar surface of the wearer's foot and the inner surface of a shoe, said insole comprising:

(a) a base having a peripheral edge defining a toe portion, a heel portion and an intermediate arch portion, said base being fabricated from a flexible, resilient cushioning material having opposite first and second generally planar surfaces;

(b) a plurality of protuberances disposed on said first surface of said base and projecting therefrom;

(c) moisture absorbing material covering said opposite first and second generally planar surfaces, said covering on said first planar surface defining openings corresponding to the location and shape of the protuberances disposed thereon to allow the protuberance to extend therethrough above the surface of the covering; and (d) said base sole defining a plurality of apertures extending through said base insole whereby said insole may be worn with said first side disposed against the wearer's foot to provide a massaging action and may be reversed and worn with said second side disposed against the wearer's foot and with said protuberances engaging the shoe inner surface to induce an air flow through said insole as walking pressure is applied to the insole.

2. The insole of claim 1 wherein at least said covering on said first planar surface is imprinted with indicia representative of selected reflex zones associated with various organs of the human body.

3. The insole of claim 1 wherein said resilient cushioning material is molded CMR.

4. The insole of claim 1 wherein said protuberances are generally convex in cross section.

5. The insole of claim 1 wherein said protuberances comprise a first series of protuberances being spaced apart on the toe portion of the insole, at least one protuberance disposed in the heel portion and an elongated protuberance having a longitudinal axis extending substantially in the direction of the elongation of the insole and disposed in said arch portion.

6. The insole of claim 1 wherein said base and protuberances are integrally formed in a molding process.

7. The insole of claim 1 wherein said openings in said material on said first planar surface are die cut.

8. The insole of claim 1 wherein said material is Neoprene.

* * * * *